US005422651A

United States Patent [19]

Chang

[11] Patent Number: 5,422,651

[45] Date of Patent: Jun. 6, 1995

[54] PIVOTAL STRUCTURE FOR CORDLESS TELEPHONE ANTENNA

[76] Inventor: Chin-Kang Chang, 61, Hsin-Kuan Road, Sec. 2, Ping-Cheng City, Tau-Yuan Hsien, Taiwan, Prov. of China

[21] Appl. No.: 135,719

[22] Filed: Oct. 13, 1993

[51] Int. Cl.[6] ..... H01Q 1/24; H01Q 3/02

[52] U.S. Cl. ..... 343/749; 343/702; 343/882

[58] Field of Search ..... 343/749, 702, 715, 900, 343/882, 888, 901; H01Q 1/24, 9/00, 3/02

[56] References Cited

U.S. PATENT DOCUMENTS

| | | | |
|---|---|---|---|
| 2,706,608 | 4/1955 | Joseph | 343/882 |
| 3,579,241 | 5/1971 | Antista | 343/702 |
| 3,946,317 | 3/1976 | Ishimaru et al. | 343/702 |
| 4,024,542 | 5/1977 | Ikawa et al. | 343/702 |
| 4,085,012 | 7/1978 | Marceau et al. | 204/38 |
| 5,214,434 | 5/1993 | Hsu | 343/906 |
| 5,218,370 | 6/1993 | Blaese | 343/702 |

FOREIGN PATENT DOCUMENTS

| | | | |
|---|---|---|---|
| 55-147806 | 11/1980 | Japan | 343/702 |

*Primary Examiner*—Donald Hajec
*Assistant Examiner*—Hoanganh Le
*Attorney, Agent, or Firm*—Schnader, Harrison, Segal & Lewis

[57] ABSTRACT

An improved pivotal structure for cordless telephone antenna is provided primarily by connecting the swivel head for mounting the antenna rod to the upper end of a plastic insulation cover with an antiskid seat which is provided on its surface with straight circumferential indentations, the lower end of the plastic insulation cover being secured to a high frequency connector, in which the antiskid seat is secured in the plastic insulation cover and the swivel head is pivoted in riveting manner to the antiskid seat by a resilient washer so as to provide a certain holding force, a pair of planar washer being interposed therebetween to provide a better friction surface such that the pivotal connector can be effectively positioned to whatever place to which the pivotal connector is rotated.

1 Claim, 5 Drawing Sheets

PIVOTAL STRUCTURE FOR CORDLESS TELEPHONE ANTENNA

FIELD OF THE INVENTION

The present invention relates to an improved structute for a cordless telephone antenna and, in particular, to a pivotal connection of a pivotal connector for mounting the antenna therefor rod with a plastic insulation cover by means of an antiskid seat provided on its surface with straight circumferential indentations, a resilient washer and planar washers so as to utilize a certain friction force provided by the resilient washer for random positioning the antenna at any angle and any position.

BACKGROUND OF THE INVENTION

It is found that use of cordless telephones is becoming more and more popular because of the advantages that such telephones are convenient to carry and can be used at any time and any place. Cordless telephones for use with a telephone set in the family and mobile telephone units are well known and both are characterized in that a handset which works to convert sound into electromagnetic waves and in the opposite way is used for communication. Since an antenna for both receiving and transmitting is required for sound signal transmission through electromagnetic waves, the antenna for transmitting and receiving electromagnetic waves for the cordless telephones is just like what a barrel is for the hand guns and gloves for the baseballs. As shown in FIG. 1, conventional cordless telephones consist primarily of a high frequency connector A, a rotating joint F, an antenna rod I, and an induction coil C, in which the rotating joint F comprises a rotating head cover D, a swivel head G, and a swinging head H, the antenna rod I being pivoted to the upper end of the swivel head G by means of the swinging head H, the lower end of the swivel head G being fitted into the rotating head cover D by a catcher E which has provided on its periphery with a plurality of longitudinal grooves and protrusions, the rotating head cover D being screwed onto the high frequency connector A, the lower end of the catcher E being formed with a hole at its center for holding the induction coil C, the upper and lower ends of the induction coil C being formed, respectively, with a short section projecting vertically from the center thereof, with the upper end being securely fitted into the holding hole on the lower end of the catcher E and the lower end being securely fitted into the holding hole on a central pin seat B, wherein the opening of the catcher E is suitably expanded under the action of the grooves so as to catch the swivel head G and the catcher E, after being fastened to the swivel head G, is squeezed into the rotating head cover D to be fixed in the rotating head cover D and to have the swivel head G suitably clamped so as to provide a holding force for directional adjustment of the antenna rod I.

However, said holding force by the catcher E against the swivel head G results from the resilient deformation effected when being pressed into the rotating head cover D. The catcher E and the swivel head G are both made from a metal material such that slight deformation produces considerable stress and once the resilient deformation is offset by the wear due to rotation, the holding force would no longer exist such that the antenna rod I would become loose. In addition, both ends of the induction coil C make contact by insertion with only small contacting surface, hence there are the drawbacks that not only they are easily subject to wear but also signal transmission is undesirable.

SUMMARY OF THE INVENTION

In view of the above disadvantages, elaborate analyses, continued trials and tests have been made and, finally after numerous improvements, successfully developed the improved structure for cordless telephone antenna of the present invention.

The object of the present invention is to provide an antenna structure for cordless telephones which overcomes the disadvantages that with conventional units, such structure is rather tight when first bought and, after use for a period of time, tends to become loose, and that the induction coil makes contact with lead ends, thus leading to poor conduction.

The above object of the present invention, the technical means utilized, and the effects thereof will be described in greater detail by way of a feasible embodiment given in conjunction with the accompanying drawings.

DESCRIPTION OF THE PREFERRED EMBODIMENTS

Figure 1:
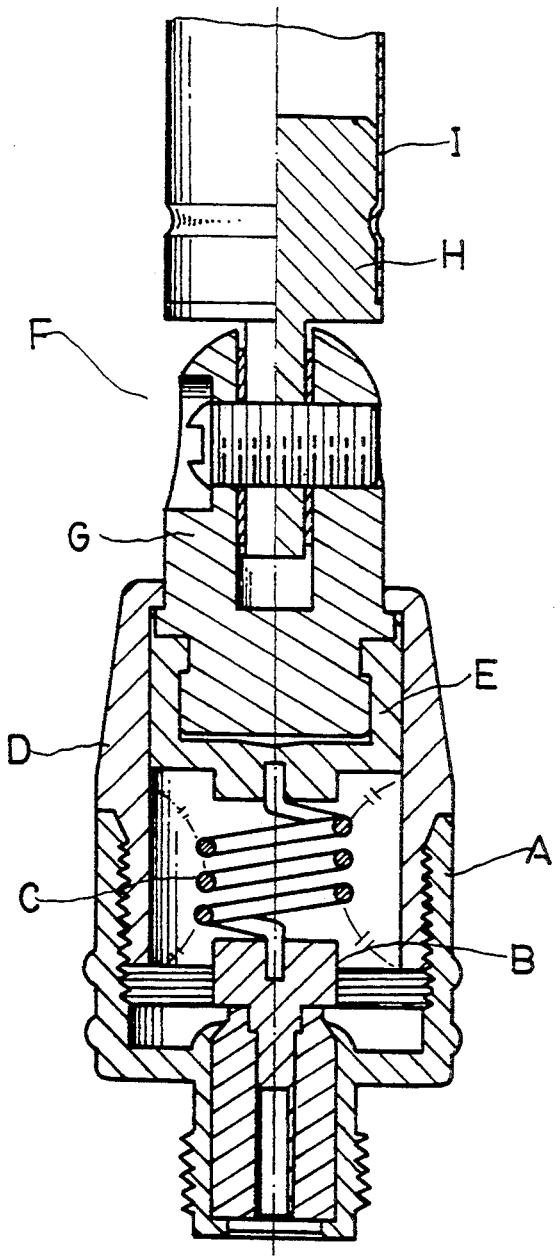
PRIOR ART FIG. 1
FIG. 1 is a cross section view of a conventional cordless telephone antenna.
Figure 2:
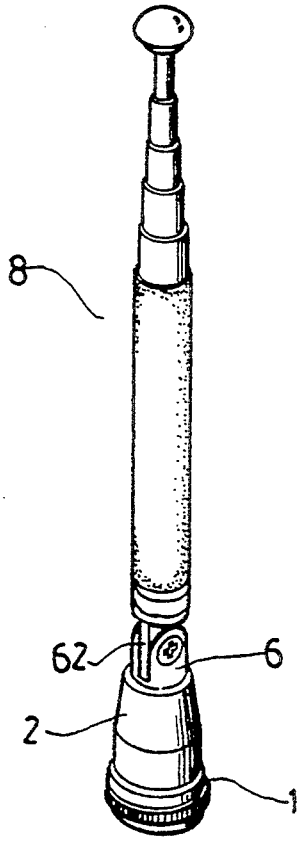
FIG. 2 is a perspective view of an embodiment of the present invention.

Referring to FIG. 2, there is shown the perspective view of an embodiment of the present invention. The improved structure for cordless telephone antenna of the present invention is seen to have a high frequency connector 1, a plastic insulation cover 2, a swivel head 5, a swinging head 6, and an antenna rod 8 wherein the antenna rod 8 is connected to the upper end of the swinging head 6, the lower end of the swinging head 6 being pivotally connected to the upper end of the swivel head 5, the swivel head 5 being fitted into the plastic insulation cover 2, and the plastic insulation cover 2 being screwed to the high frequency connector 1.

Figure 3:
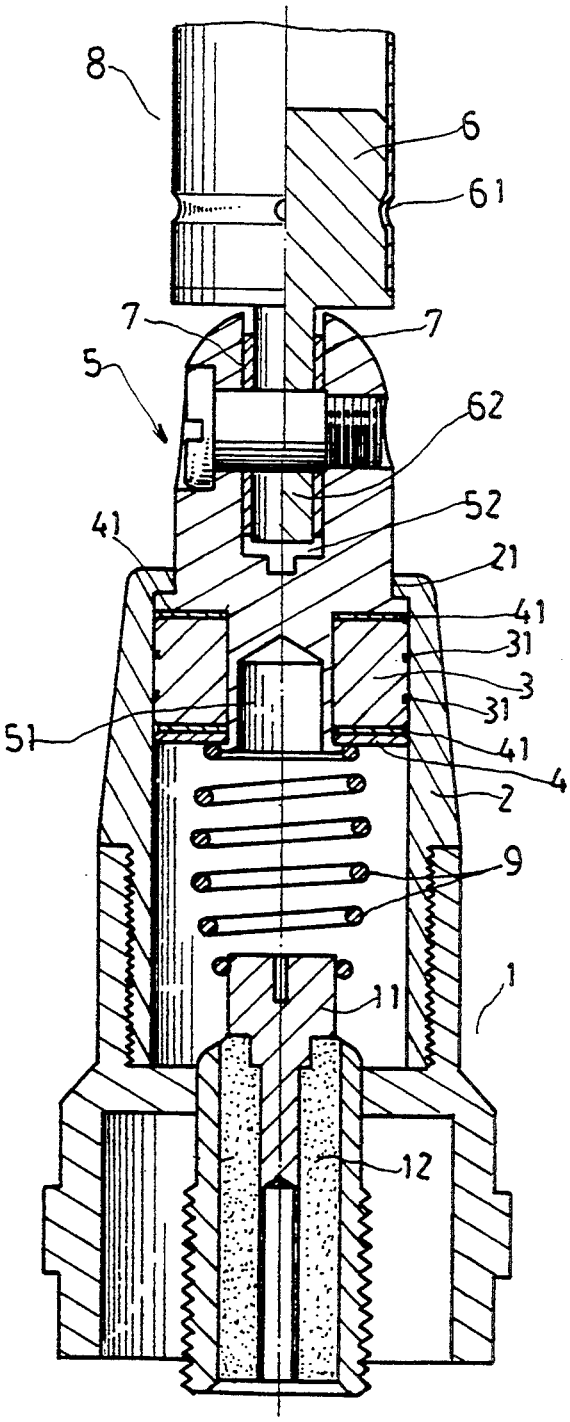
FIG. 3 is a cross section view of the embodiment of the present invention.

Referring to FIG. 3, there is shown the cross section view of the embodiment of the present invention which consists primarily of the high frequency connector 1, the plastic insulation cover 2, an antiskid seat 3, a resilient washer 4, planar washers 41, the swivel head 5, the swinging head 6, a friction washer 7, and the antenna rod 8 wherein the underside of a connecting pin 11 is formed with external threads of smaller diameter and the top side of the outer ring around the external threads is formed with internal threads with an insulation tube 12 for mounting the connecting pin 11 interposed in the center. The plastic insulation cover 2 is securely screwed to the upper end of the high frequency connector 1, the upper end thereof being formed with an inner peripheral rim 21. The underside of the swivel head 5 is formed into the shape of a round rod such that the antiskid seat 3, the resilient washer 4 and the planar washer 41 can be fitted in the plastic insulation cover 2 and the top side thereof is formed with a pivotal groove 52. The swinging head 6 is pivotally connected at the lower end in the pivotal groove 52 with a pivotal tongue 62 having a friction washer 7 disposed on either side, respectively, the antenna rod 8 being fixed to the upper end thereof by means of an annular groove 61. A spring shaped induction coil 9 is provided between the swivel head 5 and the connecting pin 11 in the plastic insulation cover 2.

Figure 4:
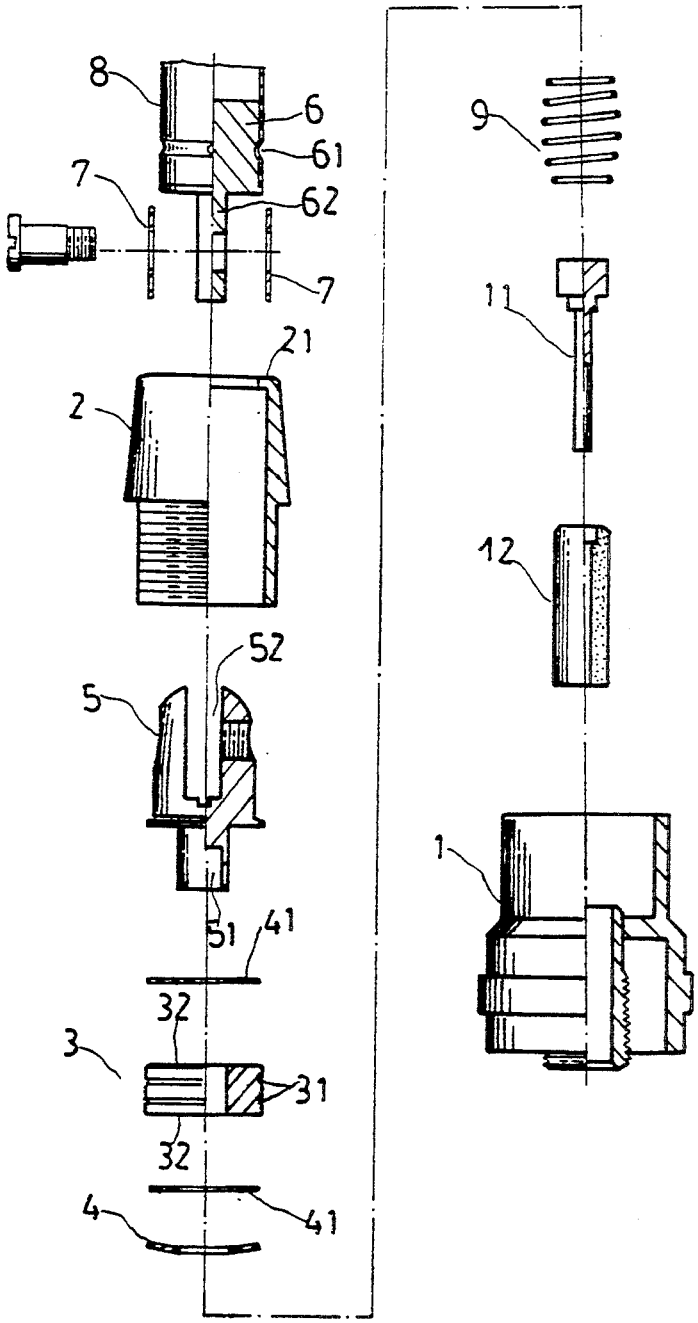
FIG. 4 is an exploded view of the embodiment of the present invention.

Referring to FIG. 4, there is shown the exploded view of the embodiment of the present invention. The various components and the assembling process are shown as in FIG. 4. A planar washer 41, the antiskid seat 3, another planar washer 41 and the resilient washer 4 are first fitted in sequence over the round rod portion at the lower end of the swivel head 5, and then the open end of the preformed hole 51 is slightly expanded and bent outward to become deformed so as to have them riveted. A suitable amoung of a deoxidated adhesive is applied in the lateral circumferential groove 31 around the riveted antiskid seat 3, said antiskid seat 3 being then pressed into the plastic insulation cover 2 such that the antiskid seat 3 is securely fixed in the plastic insulation cover 2 near the upper end by means of the longitudinal indentations 32 and the deoxidated adhesive, the spring shaped induction coil 9 being then placed thereinto and screwed to the high frequency connector 1 by means of the internal threads at the lower end. Before the high frequency connector 1 is screwed, the connecting pin 11 is disposed in the center thereof by means of an insulation tube 12. The upper end of the swivel head 5 is pivotally connected to the pivotal tongue 62 at the lower end of the swinging head 6 by means of a pivotal groove 52 with a friction washer 7 being interposed between the adjacent sides. The upper end of the swinging head 6 is joined to the antenna rod 8 by means of the annular groove 61.

Figure 5:
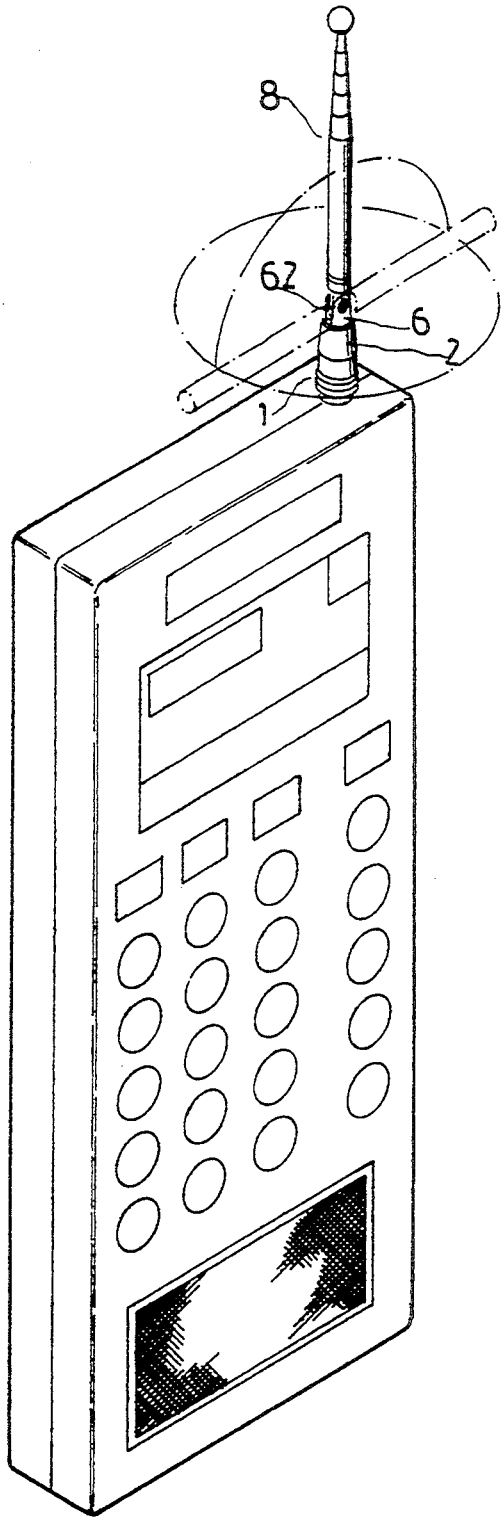
FIG. 5 is a view showing the embodiment of the present invention in operating condition.

Referring to FIG. 5, there is shown the embodiment of the present invention as seen in operating condition. The embodiment of the present invention is shown in the condition for use in a mobile telephone unit in which the antenna rod 8 consists of a plurality of metal tubes of increased diameters and fitted in telescopic relationship such that they can be pulled out to form into a longer antenna for better signal reception. Since the antenna rod 8 is connected to the mobile telephone through the swivel head 5 and the swinging head 6, it is possible to make adjustment in 180 degrees and directional changes in 360 degrees for convenient operation.

From the foregoing, the present invention provides the effect of strengthened connection of the antiskid seat 3 to the plastic insulation cover 2 by filling the deoxidated adhesive in the lateral circumferential groove 31 therearound. A constant holding force is provided by the resilient washer 4 through riveting connection such that the antenna rod 8 can be effectively positioned at any angle and any direction. The spring shaped induction coil 9 used for conduction ensures good conducting effect and overcomes the drawback of easy loosening and thus avoiding poor contact and conduction.

Although the preferred embodiment has been described in detail, it should be understood that various modifications and changes can be made by those skilled in the art without departing from the spirit and scope of the present invention as defined in the appended claim.

I claim:

1. An improved pivotal structure for a cordless telephone antenna, comprising:

a high frequency connector with a connecting pin disposed in the center thereof by means of an insulation tube;

a plastic insulation cover screwed to the upper end of said high frequency connector;

an antiskid seat press fitted in the plastic insulation cover having an upper end and a lower end and having a plurality of longitudinal indentations around the periphery;

a swivel head with a round lower end fitted in the antiskid seat and an upper end formed into a pivotal groove;

a swinging head pivotally connected at the lower end in the pivotal groove with a pivotal tongue having a friction washer disposed on either side, respectively;

an induction coil positioned between the connecting pin and the antiskid seat in the plastic insulation cover;

wherein the improvement comprises:

the lower end of said swivel head is formed into a round rod with the end having a preformed hole;

said antiskid seat is fitted over the round rod of the swivel head, the periphery being formed with at least one lateral circumferential groove filled with deoxidated adhesive;

said induction coil is formed into the shape of a spring having flat ends;

a pair of planar washers each with a central hole fitted on the upper and lower ends of the antiskid seat, said antiskid seat and said pair of washers being inserted together over the round rod at the lower end of the swivel head;

a resilient washer riveted to the round rod of the swivel head;

such that the antiskid seat is securely adhered in the plastic insulation cover by filling the at least one lateral circumferential groove with the deoxidated adhesive;

the spring shaped induction coil having flat ends is utilized for positive signal transmission; a holding force is produced by the resilient washer and the planar washers are used to provide a better friction surface.

* * * * *